US009073369B2

(12) United States Patent
Yanagishita

(10) Patent No.: US 9,073,369 B2
(45) Date of Patent: Jul. 7, 2015

(54) RECORDING APPARATUS AND METHOD OF MANUFACTURING RECORDED MATTER

(71) Applicant: SEIKO EPSON CORPORATION, Tokyo (JP)

(72) Inventor: Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 188 days.

(21) Appl. No.: 13/841,708

(22) Filed: Mar. 15, 2013

(65) Prior Publication Data

US 2013/0336702 A1 Dec. 19, 2013

(30) Foreign Application Priority Data

Jun. 13, 2012 (JP) ..... 2012-134178

(51) Int. Cl.

| | |
|---|---|
| ***B41J 11/00*** | (2006.01) |
| ***B41F 15/18*** | (2006.01) |
| ***B41F 1/38*** | (2006.01) |
| ***B41F 16/02*** | (2006.01) |
| ***B41J 15/16*** | (2006.01) |

(52) U.S. Cl.

CPC ..... *B41J 15/16* (2013.01)

(58) Field of Classification Search

CPC ..... B41F 15/18; B41F 1/38; B41F 16/02; B41J 11/00; B41J 15/16

USPC ..... 347/104; 101/407, 474, 407.1, 126; 400/48

See application file for complete search history.

(56) References Cited

U.S. PATENT DOCUMENTS

| | | | | | |
|---|---|---|---|---|---|
| 4,875,268 | A * | 10/1989 | Szarka | 29/283 |
| 4,981,075 | A * | 1/1991 | Christman | 101/127.1 |
| 5,161,466 | A * | 11/1992 | Burris | 101/474 |
| 5,188,034 | A * | 2/1993 | Iaccino et al. | 101/474 |
| 5,199,353 | A * | 4/1993 | Szyszko | 101/474 |
| 5,247,885 | A * | 9/1993 | Iaccino et al. | 101/474 |
| 5,544,581 | A * | 8/1996 | Haji | 101/126 |
| 6,095,628 | A * | 8/2000 | Rhome | 347/4 |
| 6,631,985 | B2 * | 10/2003 | Koizumi et al. | 347/101 |
| 6,640,714 | B1 * | 11/2003 | Papa | 101/474 |
| 6,908,190 | B2 | 6/2005 | Iwatsuki et al. | |
| 7,013,801 | B2 * | 3/2006 | Edson | 101/123 |
| 7,311,041 | B2 * | 12/2007 | Niimi | 101/114 |
| 7,954,921 | B2 * | 6/2011 | Ben-Zur et al. | 347/21 |
| 8,042,462 | B2 * | 10/2011 | Kim | 101/41 |
| 2003/0197772 | A1 | 10/2003 | Iwatsuki et al. | |
| 2005/0179708 | A1 * | 8/2005 | Ben-Zur | 347/2 |
| 2006/0203069 | A1 * | 9/2006 | Niimi et al. | 347/104 |
| 2008/0163775 | A1 * | 7/2008 | Livingston | 101/474 |
| 2010/0092677 | A1 * | 4/2010 | Ozawa | 427/275 |
| 2012/0037024 | A1 * | 2/2012 | Styles et al. | 101/407.1 |

FOREIGN PATENT DOCUMENTS

| | | | | |
|---|---|---|---|---|
| EP | 509803 | A1 * | 10/1992 | B41F 15/22 |
| JP | 61134256 | A * | 6/1986 | B41F 15/18 |
| JP | 2003-312069 | | 11/2003 | |

* cited by examiner

*Primary Examiner* — Nguyen Ha

(74) *Attorney, Agent, or Firm* — Workman Nydegger

(57) ABSTRACT

A recording apparatus includes a tray having a set surface on which a recording medium is set; a recording section performing recording with respect to a region of the recorded matter, which is set on the set surface; and a pulling mechanism which applies a force from the set surface of the recorded matter to a protruding portion in a first direction and capable of pulling the portion of the recording medium, which is set on the set surface.

9 Claims, 11 Drawing Sheets

RECORDING APPARATUS AND METHOD OF MANUFACTURING RECORDED MATTER

CROSS-REFERENCE TO RELATED APPLICATIONS

The entire disclosure of Japanese Patent Application No. 2012-134178, filed Jun. 13, 2012 is expressly incorporated by reference herein.

BACKGROUND

1. Technical Field

The present invention relates to a recording apparatus performing recording on a recording medium and a method of manufacturing a recorded matter.

2. Related Art

In the related art, a recording apparatus capable of recording on various types of recording media has been used. In such recording apparatuses, a recording apparatus capable of using fabric as a recorded matter has been also often used. The fabric as a recorded matter has a variety of materials and thicknesses, and is characterized in that wrinkling is more likely to occur than other recorded matters such as a recording paper.

For example, JP-A-2003-312069 discloses a platen device of an ink jet recording apparatus capable of using a fabric as a recording medium. The platen device has a platen on which a recording medium is inserted and is capable of being placed, and an outer frame capable of sandwiching the recording medium which is inserted and placed on the platen. Then, the platen device is capable of applying tension to the recording medium by sandwiching the platen on which the recording medium is placed with the outer frame.

The platen device disclosed in JP-A-2003-312069 has a configuration such that the tension is applied to the recording medium by sandwiching the recording medium inserted and placed on the platen with the outer frame. Thus, tension is applied and wrinkling can be suppressed in the recording medium having a predetermined thickness. However, the platen device may not sandwich the recording medium having a thickness over a predetermined thickness with the outer frame.

In addition, the platen device described above has a structure in which the recording medium is inserted into the platen and then the platen on which the recording medium is placed is sandwiched with the outer frame. Thus, there is a problem in that it takes time and effort for a user to remove the wrinkle.

SUMMARY

An advantage of some aspects of the invention is to provide a recording apparatus in which the work of removing wrinkles is easily performed and the recording apparatus corresponds to the recording medium having a variety of thicknesses and the wrinkles of the recording medium are easily suppressed.

According to a recording apparatus of an aspect of the invention, there is provided a recording apparatus including a tray having a set surface on which a recording medium is set; a recording section performing recording with respect to a region of the recorded medium, which is set on the set surface so as to have a protruding portion protruding from the a set surface of the recording medium; and a pulling mechanism which applies a force to the protruding portion in a first direction to pull the set surface portion of the recording medium, which is set on the set surface.

According to the recording apparatus of the aspect of the invention, the pulling mechanism applies the force to the protruding portion of the set surface of the recording medium so that the set surface portion on the set surface is pulled from the both sides thereof. Thus, a user performs easily the work to remove the wrinkle without requiring time and effort. In other words, in the set surface portion of the recording medium, which is set on the set surface, the wrinkle is removed and the wrinkle is suppressed by the pulling mechanism. In addition, the recording apparatus of the aspect of the invention may have the configuration in which the force applied to the protruding portion from the set surface and the recording apparatus may correspond to the recording medium having various thickness.

In the recording apparatus, the pulling mechanism may have an abutting section capable of abutting the protruding portion with a line contact in a second direction orthogonal to the first direction and along the set surface and the abutting section may apply the force to the protruding portion by abutting the protruding portion.

Here, "the second direction orthogonal to the first direction and along the set surface" means a direction along the set surface and further the direction orthogonal to the first direction. For example, the direction is the direction orthogonal to the first direction but it is not limited to the direction orthogonal to the first direction. In addition, "the line contact" means the line contact in macro point of view. Thus, if it is the surface contact in the micro point of view and it is the line contact in the micro point of view, both are included in the aspect of the invention.

According to the recording apparatus of the aspect of the invention, the abutting section abuts the protruding portion with the line contact in the second direction. Thus, the abutting section can uniformly apply the force to all protruding portions with respect to the recording medium which is set.

In the recording apparatus, a length of the abutting section in a second direction may correspond to the length of the tray in the second direction.

Here, the length of the abutting section in the second direction "corresponds to" the length of the tray in the second direction. The expression "corresponding to" means that the lengths of both are not significantly different. In other words, the lengths of both may not be exactly the same as each other.

According to the recording apparatus of the aspect of the invention, the length of the abutting section in the second direction corresponds to the length of the tray in the second direction. Thus, since the lengths of the abutting section and the tray in the second direction, respectively correspond to each other, an increase in size of the pulling mechanism is suppressed and, at the same time, the abutting section can effectively apply the force to the protruding portion.

In the recording apparatus, the pulling mechanism may have a connection section capable of rotating in the second direction which is set as the direction of a rotation shaft in the opposite side of the abutting section, and the abutting section may abut the protruding portion by the rotation.

According to the recording apparatus of the aspect of the invention, the abutting section can abut the protruding portion by rotation in the connection section. Thus, the abutting section can abut the protruding portion with a simple configuration.

In the recording apparatus, a portion of the region in the set surface may have a coefficient of friction to the recording medium, which is greater than that of other regions.

According to the recording apparatus of the aspect of the invention, a portion of the region in the set surface has the coefficient of friction to the recording medium, which is greater than that of other regions. Thus, the recording medium can be pulled from the both sides, on the basis of a portion of the region of which the coefficient of friction is great. In other words, the recording medium which is set on the set surface can be effectively pulled and the wrinkle can be effectively suppressed.

Here, it is preferable that "a portion of the region of which the coefficient of friction is great" may be set in the center portion of the set surface of the tray. This is because balance of the force is improved. In addition, "the center portion" is not necessarily to be a true center position and the center portion may be a region that is substantially center to the extent that the balance is improved.

In the recording apparatus, the connection section may have a free stop function.

Here, "the free stop function" means a function in which the pulling mechanism is capable of being stopped at any angle with respect to a connection surface of the connection section.

According to the recording apparatus of the aspect of the invention, the connection section has the free stop function. Thus, the abutting section abuts the protruding portion and can apply the force to the protruding portion with a simple configuration.

In the recording apparatus, the abutting section may abut the protruding portion by an own weight of the pulling mechanism when the pulling mechanism is inclined.

According to the recording apparatus of the aspect of the invention, the abutting section abuts the protruding portion by the own weight of the pulling mechanism when the pulling mechanism is inclined. Thus, the abutting section abuts the protruding portion and can apply the force to the protruding portion with a simple configuration.

In the recording apparatus, the pulling mechanism may have a biasing member pressing the abutting section to the protruding portion.

According to the recording apparatus of the aspect of the invention, the pulling mechanism has the biasing member pressing the abutting section to the protruding portion. Thus, the abutting section abuts the protruding portion and can apply the force to the protruding portion with a simple configuration.

In the recording apparatus, the pulling mechanism may include a refraction section between the connection section and the abutting section along the second direction, and may be capable of refracting along the second direction.

According to the recording apparatus of the aspect of the invention, the pulling mechanism is capable of refracting along the second direction. Thus, it is possible to refract the refraction section when a large recording medium is used and it is possible to extend the refraction section when a small recording medium is used. In other words, the recording apparatus of the aspect can correspond to the recording medium having various sizes.

In the recording apparatus, the pulling mechanism may have a plurality of the abutting sections abutting the protruding portion and a pressing section capable of applying a force to the plurality of the abutting sections so that the tension acts on the set portion in the second direction orthogonal to the first direction along the set surface.

According to the recording apparatus of the aspect of the invention, the pressing section of the pulling mechanism applies the force to the plurality of the abutting sections so that the tension acts on the set portion in the second direction. In addition, the pulling mechanism applies the force to the protruding portion from the set surface so that the set portion to the set surface is pulled from the both sides in the first direction. Thus, the set portion can be pulled from four directions. In other words, the recording medium which is set on the set surface can be effectively pulled and the wrinkle can be effectively suppressed.

In the recording apparatus, the recording apparatus may further include a recording section performing the recording on the recording medium and a moving mechanism which relatively moves the tray with respect to the recording section in the second direction orthogonal to the first direction along the set surface for performing the recording.

Here, "the relatively moving mechanism" includes any one of a configuration in which the tray moves with respect to the recording section and a configuration in which the recording section moves with respect to the tray and a configuration in which both the recording section and the tray move.

According to the recording apparatus of the aspect of the invention, the invention can be the configuration in which the pulling mechanism applies the force to the protruding portion from the both left and right sides with respect to the direction where the tray and the recording section relatively move. In other words, the invention can be the configuration in which the user operates the pulling mechanism of both the left and right sides from the front side of the recording apparatus. Thus, operation ability of the user can be improved.

In the recording apparatus, the pulling mechanism is capable of applying a force to the protruding portion from the set surface of the recording medium so that the portion, which is set, is pulled from the both sides in the first direction and the second direction orthogonal to the first direction along the set surface, respectively.

According to the recording apparatus of the aspect of the invention, the protruding portion of the recording medium can be pulled from the set surface in four directions. In other words, the recording medium set on the set surface can be effectively pulled and the wrinkle can be effectively suppressed.

According to a method of manufacturing recorded matter of another aspect of the invention, there is provided a manufacturing method including setting a recording medium by protruding the recording medium from both sides on a tray in a first direction having a set surface on which a recording medium is set; pulling the recording medium by applying a force to a set surface of the recording medium to a protruding portion so that a portion of the recording medium, which is set on the set surface, is pulled from both sides thereof; and performing recording on the portion of the recording medium, which is set, in a state where the force is applied.

According to the method of the aspect of the invention, in the pulling step, the force is applied to the protruding portion from the set surface so that the portion which is set on the set surface is pulled from both sides. Thus, the wrinkle of the portion which is set on the set surface is removed. Then, in the recording step, a preferable recorded matter can be produced by recording the recording medium while maintaining a state where the wrinkle is removed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a recording apparatus of the invention will be described in detail with reference to the accompanying drawings.

The embodiments below are described using an ink jet recording apparatus as a recording apparatus which performs the recording by ejecting the ink from a recording head. However, the invention is not limited to the ink jet recording apparatus. For example, the invention also includes a transfer type recording apparatus or the like.

In addition, the recording apparatus of the invention includes a moving mechanism which relatively moves a tray with respect to a recording section. All of the embodiments below are described using the recording apparatus having the moving mechanism which moves the tray with respect to the recording section. However, the recording apparatus of the invention also includes a recording apparatus performing the recording by not moving the tray, but moving the recording section. Furthermore, the invention also includes a recording apparatus having a structure which moves the both.

In addition, all of the embodiments below are described using a fabric in the form of a T-shirt as the recording medium. However, the recording medium capable of being used in the invention is not limited to the T-shirt and is also not limited to the fabric.

First Embodiment (FIGS. 1 to 5)

Figure 1:
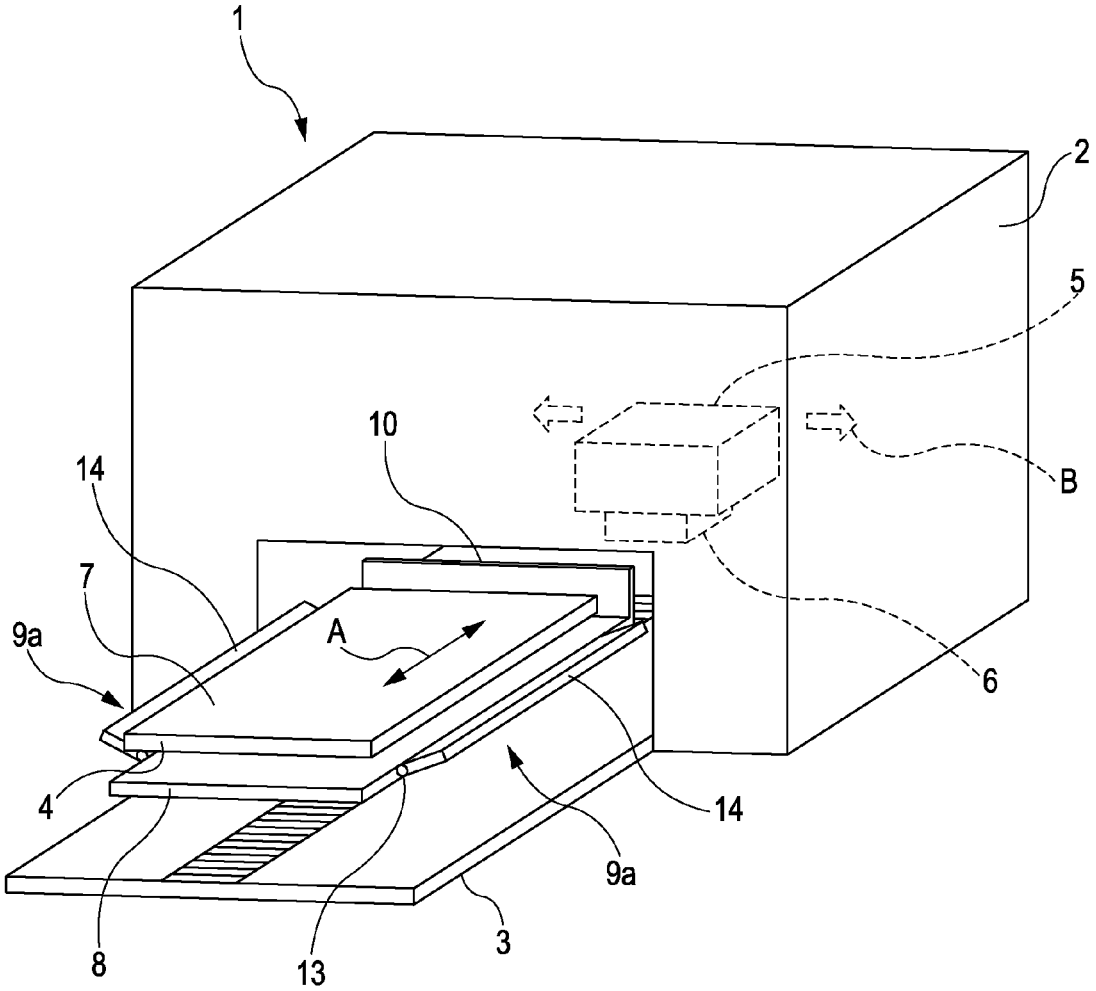
FIG. 1 is a schematic perspective view of a recording apparatus according to a first embodiment of the invention.

FIG. 1 is a schematic perspective view of the recording apparatus according to the first embodiment of the invention.

A recording apparatus 1 of the present embodiment includes a tray 4 having a set surface 7 setting a recording medium P (see, FIG. 3). A transportation section 3, as a moving mechanism, transports the recording medium P by moving the tray 4 in a transportation direction A along the set surface 7. A receiving tray 8 is included and is capable of receiving a protruding portion of the set surface 7 of the recording medium P in the lower portion of the tray 4. The receiving tray 8 has a plate member 10 to hide the inside of the recording apparatus 1.

In addition, the receiving tray 8 has wing-shaped members 9*a* on both left and right sides with respect to the transportation direction A. The wing-shaped members 9*a* are a pulling mechanism capable of applying a force from the set surface 7 of the recording medium P to the protruding portion. The wing-shaped members 9*a* are a rectangular shape and one side thereof has a connection section 13 capable of rotating about the transportation direction A, which is set as a direction of the rotation shaft. Then, the wing-shaped members 9*a* are mounted on the receiving tray 8 via the connection section 13. In addition, one side of the opposite side of the connection section 13 of the wing-shaped member 9*a* has an abutting section 14 capable of abutting the recording medium P by in line contact in the transportation direction A.

The recording apparatus 1 of the embodiment has a first direction that is a direction perpendicular to the transportation direction A along the set surface 7. The protruding portion of the recording medium P may be pulled by the wing-shaped members 9*a* from both sides in the first direction from the set surface. However, the first direction of the invention is not limited to the direction perpendicular to the transportation direction A and may be any direction if it crosses the transportation direction A along the set surface 7. In addition, in the recording apparatus 1 of the embodiment, a second direction of the invention is the transportation direction A.

An apparatus body 2 includes a recording head 6 as a recording section. The recording apparatus 1 forms a desired image by ejecting the ink on the recording medium P from the recording head 6 while reciprocating the recording head 6 in a carriage 5 in a scanning direction B perpendicular to the transportation direction A.

Figure 2:
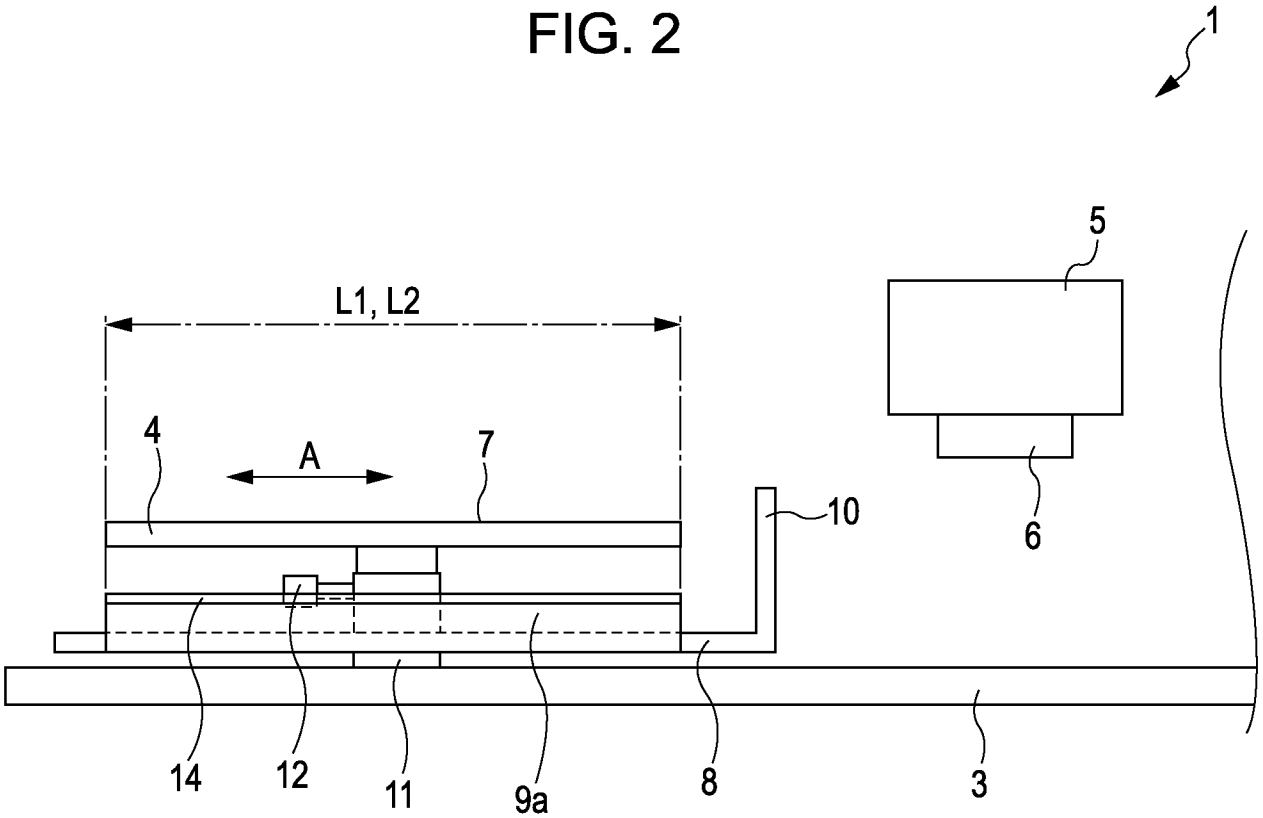
FIG. 2 is a schematic side view of the recording apparatus according to the first embodiment of the invention.

FIG. 2 is a schematic side view of the recording apparatus according to the first embodiment of the invention.

A user may adjust the height of the set surface 7 of the tray 4 by rotating a height adjustment lever 12 provided in support mechanism 11. In addition, the tray 4, the support mechanism 11, the height adjustment lever 12, the receiving tray 8, the wing-shaped members 9*a* and the plate member 10 are integrally moved by the transportation section 3 in the transportation direction A.

In the recording apparatus 1 of the embodiment, a length L1 of the tray 4 in the transportation direction A is the same as a length L2 of the abutting section 14 of the wing-shaped member 9*a* in the transportation direction A. Thus, a force may be effectively applied to the protruding portion of the set surface 7 of the recording medium P by the wing-shaped member 9*a* without increasing the size of the wing-shaped member 9*a*. However, the invention is not limited to the configuration in which a length of the tray 4 in the transportation direction A is the same as a length of the wing-shaped member 9*a*.

Figure 3A:
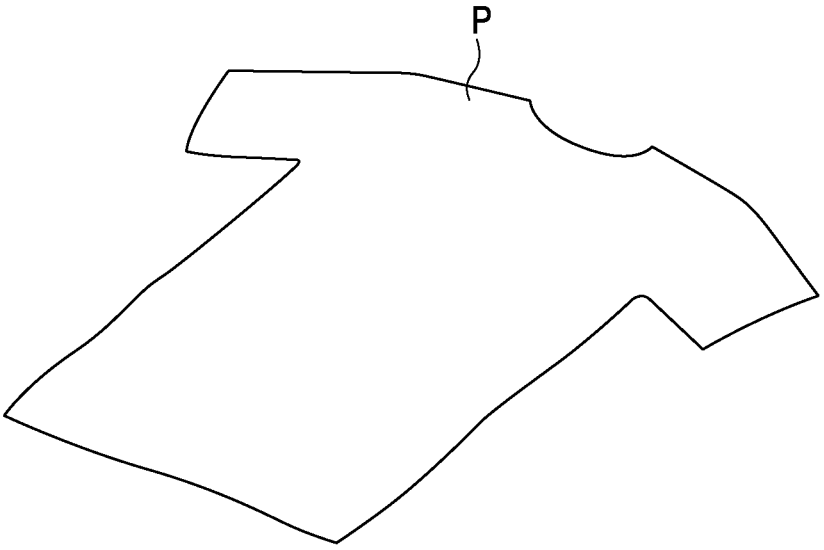
FIGS. 3A and 3B are perspective views illustrating an example of a recording medium of the invention.
Figure 3B:
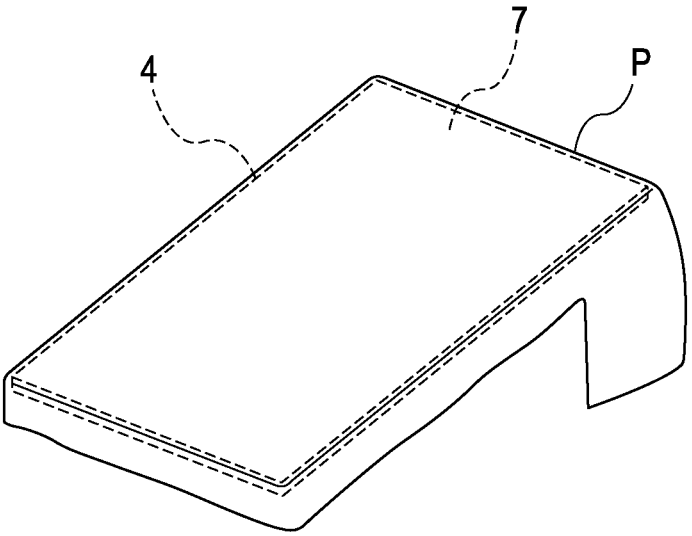

FIG. 3A is a perspective view illustrating an example of the recording medium of the invention and FIG. 3B is a perspective view of a state where the recording medium is set on the tray 4.

FIG. 3A illustrates a T-shirt as the recording medium P of the embodiment. As illustrated in FIG. 3B, the recording medium P is set by protruding from the set surface 7 of the tray 4. In the embodiment, the recording medium P is set by protruding from the set surface 7 of the tray 4 in four directions. However, the invention may have a configuration in which the recording medium P may be set by protruding from both sides in the first direction along the set surface 7 and is not limited to the configuration in which the recording medium P is set by protruding from the set surface 7 in four directions.

Next, the operation of the wing-shaped member 9*a* will be described when the wing-shaped member 9*a* applies the force to the protruding portion of the set surface 7 of the recording medium P using FIGS. 4 and 5.

Figure 4:
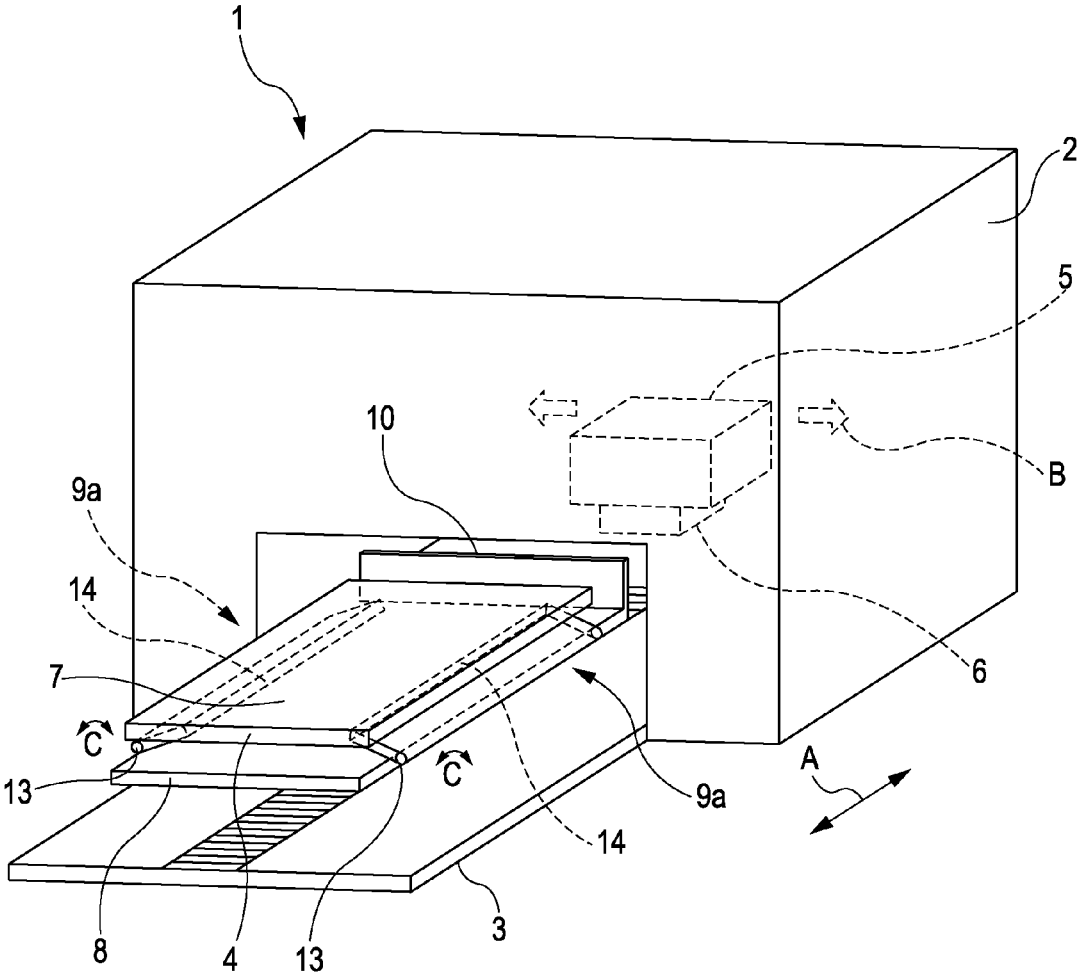
FIG. 4 is a schematic side view of the recording apparatus according to the first embodiment of the invention.

FIG. 4 is a schematic perspective view of the recording apparatus according to the first embodiment of the invention and a view illustrating the operation of the wing-shaped member 9*a*.

Two wing-shaped members 9*a* have the connection sections 13 capable of rotating in a direction C of which the direction of the rotation shaft is the transportation direction A. The abutting section 14 of the wing-shaped member 9*a* is capable of abutting the protruding portion of the set surface 7 of the recording medium P by rotation of the connection section 13.

Figure 5A:
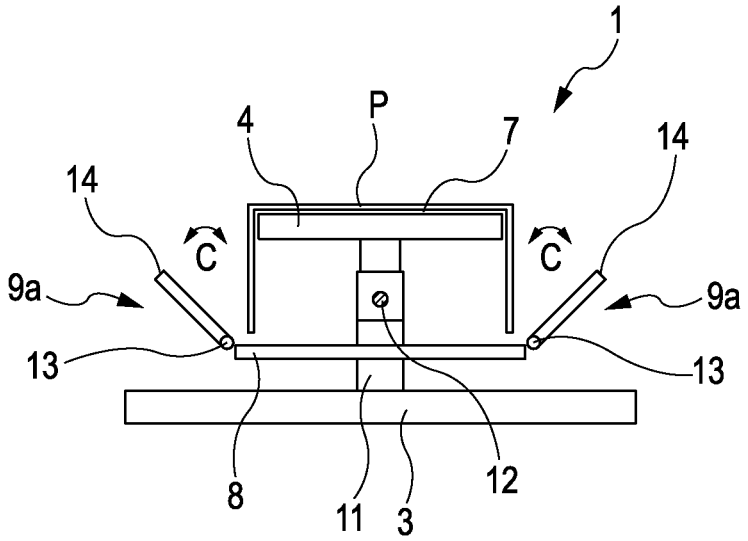
FIGS. 5A and 5B are schematic front views of the recording apparatus according to the first embodiment of the invention.
Figure 5B:
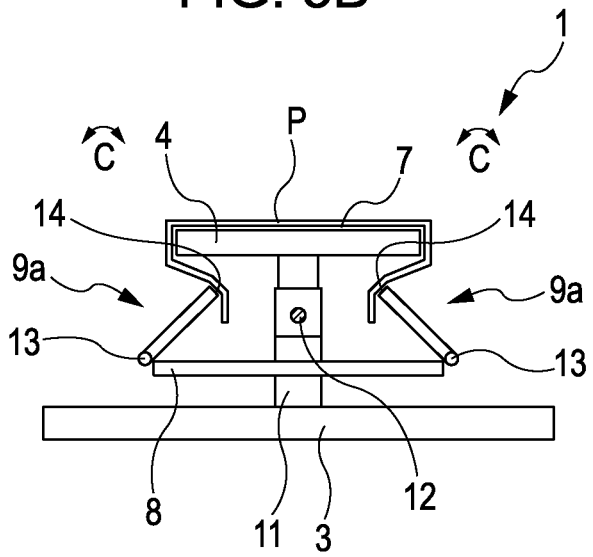

FIGS. 5A and 5B are schematic front views of the recording apparatus according to the first embodiment of the invention. FIG. 5A is a view illustrating a state where the wing-shaped member 9*a* does not apply force to the protruding portion of the set surface 7 of the recording medium P. FIG. 5B is a view illustrating a state where the wing-shaped member 9*a* applies force to the protruding portion of the set surface 7 of the recording medium P.

In FIG. 5A, the recording medium P does not abut the wing-shaped members 9*a* included in both sides of the receiving tray 8 and the force is not applied to the protruding portion of the set surface 7 of the recording medium P. Next, in FIG. 5B, the abutting sections 14 of the wing-shaped members 9*a* included in both sides of the receiving tray 8 abut the protruding portion of the set surface 7 of the recording medium P. The wing-shaped members 9*a* abut the protruding portion of the set surface 7 of the recording medium P so as to be sandwiched between two wing-shaped members 9*a* included in the both sides of the receiving tray 8 and then the force is applied to the portion which is set in the set surface 7 of the recording medium P by pulling from the both sides thereof.

In addition, it is preferable that the abutting section 14 be configured from a material having a great coefficient of friction with respect to the recording medium P so that the force may be applied to the set portion.

In addition, the connection section 13 of the embodiment has a free stop function. Thus, the abutting section 14 abuts the protruding portion of the set surface 7 of the recording medium P and then the force may be applied with a simple structure. However, the invention is not limited to the wing-shaped member 9*a* having such a configuration. For example, the invention may be applied to a configuration in which the wing-shaped members 9*a* abuts the protruding portion of the set surface 7 of the recording medium P by its own weight when the wing-shaped members 9*a* are inclined and then force is applied to the protruding portion.

Figure 6A:
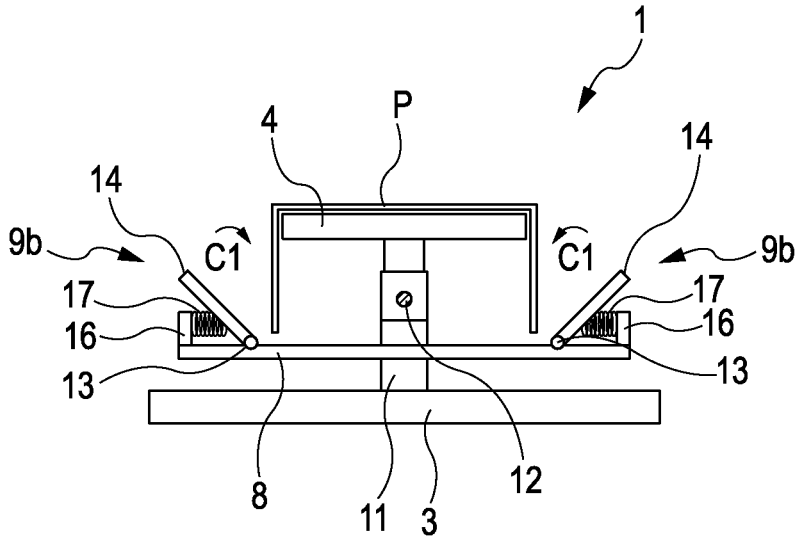
FIGS. 6A and 6B are schematic front views of the recording apparatus according to a second embodiment of the invention.
Figure 6B:
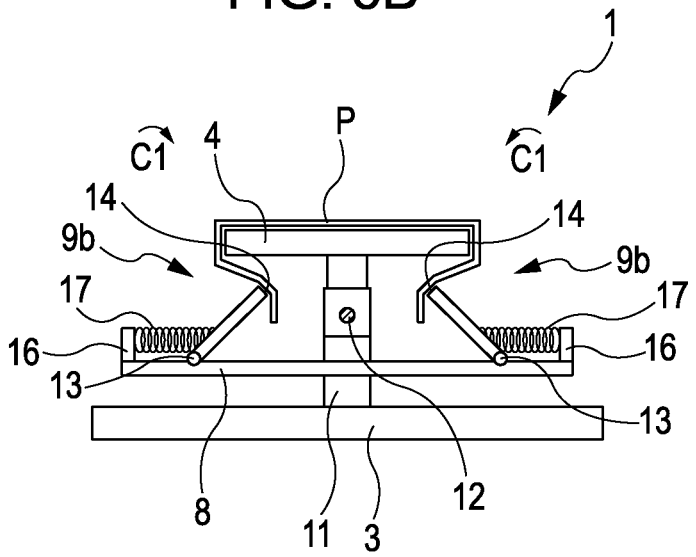

Second Embodiment (FIGS. 6A and 6B)

FIGS. 6A and 6B are schematic front views of the recording apparatus according to the second embodiment of the invention. The same reference numeral will be given to the same configuration member in the first embodiment and repeated description thereof will be omitted.

FIG. 6A is a view illustrating a state where the wing-shaped members 9*b* do not apply the force to the protruding portion of the set surface 7 of the recording medium P. FIG. 6B is a view illustrating a state where the wing-shaped members 9*b* apply the force to the protruding portion of the set surface 7 of the recording medium P.

The recording apparatus 1 of the embodiment has the wing-shaped members 9*b* in the both sides of the receiving tray 8, which are the same shapes as the wing-shaped members 9*a* and the connection section 13 which rotates in a rotation direction C1 without having the free stop function. In addition, the recording apparatus 1 of the embodiment has biasing members configured of a fixing member 16 and an elastic member 17 outside both wing-shaped members 9*b*, respectively. In other words, the recording apparatus of the embodiment is capable of acting the biasing force to the wing-shaped members 9*b* in the rotation direction C1. In FIG. 6B, the abutting sections 14 of the wing-shaped members 9*b* included in the both sides of the receiving tray 8 abut the protruding portion of the set surface 7 of the recording medium P and then the biasing force is acted in the rotation direction C1. Accordingly, the force is applied so that the portion that is set in the set surface 7 of the recording medium P is pulled from the both sides thereof.

Figure 7A:
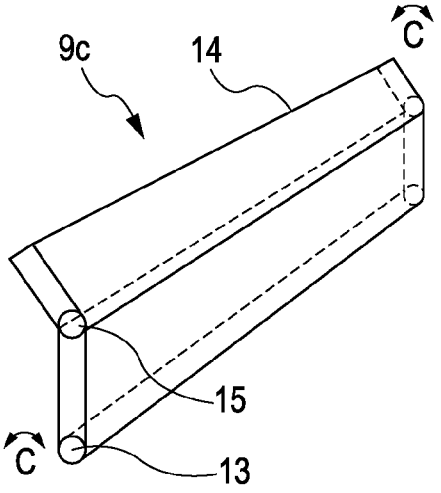
FIGS. 7A to 7C are schematic perspective views of a main portion of the recording apparatus according to a third to fifth embodiments of the invention.
Figure 7B:
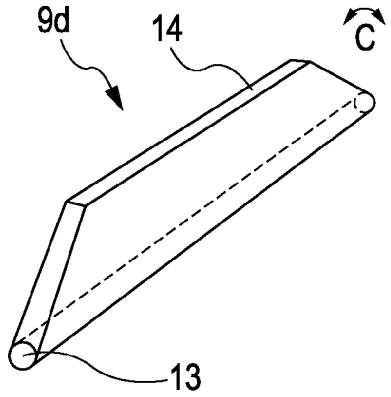
Figure 7C:
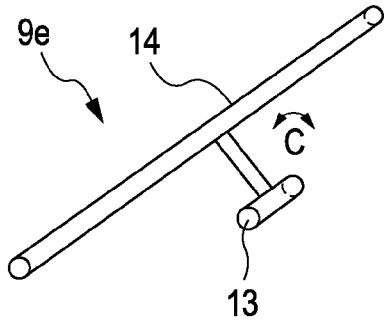

Third to Fifth Embodiments (FIGS. 7A to 7C)

FIGS. 7A to 7C are schematic perspective views of a main portion (the wing-shaped member as the pulling mechanism) of the recording apparatus according to a third to fifth embodiments of the invention. The same reference numeral will be given to the same configuration member in the first embodiment and repeated description thereof will be omitted.

FIG. 7A is a schematic perspective view of the wing-shaped member 9*c* according to the third embodiment of the embodiment. The wing-shaped member 9*c* includes a hinge 15 as a bending section between the connection section 13 and the abutting section 14 about the longitudinal direction (the same direction as the transportation direction A) of the wing-shaped member 9*c*. Thus, the wing-shaped member 9*c* is capable of bending in the rotation direction C about the longitudinal direction of the wing-shaped member 9*c*. In addition, the hinge 15 has the free stop function. Thus, it is possible to stop by refracting the hinge 15 when a large recording medium is used and it is possible to stop by extending the hinge 15 when a small recording medium is used.

In other words, the recording apparatus of the embodiment may correspond to the recording medium having various sizes.

FIG. 7B is a schematic perspective view of a wing-shaped member 9*d* according to the fourth embodiment of the embodiment. The wing-shaped member 9*d* is configured such that the length of the connection section 13 in the longitudinal direction (the same direction as the transportation direction A) is shorter than the length of the abutting section 14 in the longitudinal direction. The recording apparatus of the embodiment may use the wing-shaped member having such a shape.

FIG. 7C is a schematic perspective view of a wing-shaped member 9*e* according to the fifth embodiment of the invention. The wing-shaped member 9*e* is not a plate-shaped member but is a member having a shape in which the rod-shaped abutting section 14 of which the longitudinal direction is the transportation direction A is connected to the connection section 13 by a rod-shaped member. The recording apparatus of the invention may use the wing-shaped member having such a shape.

Figure 8:
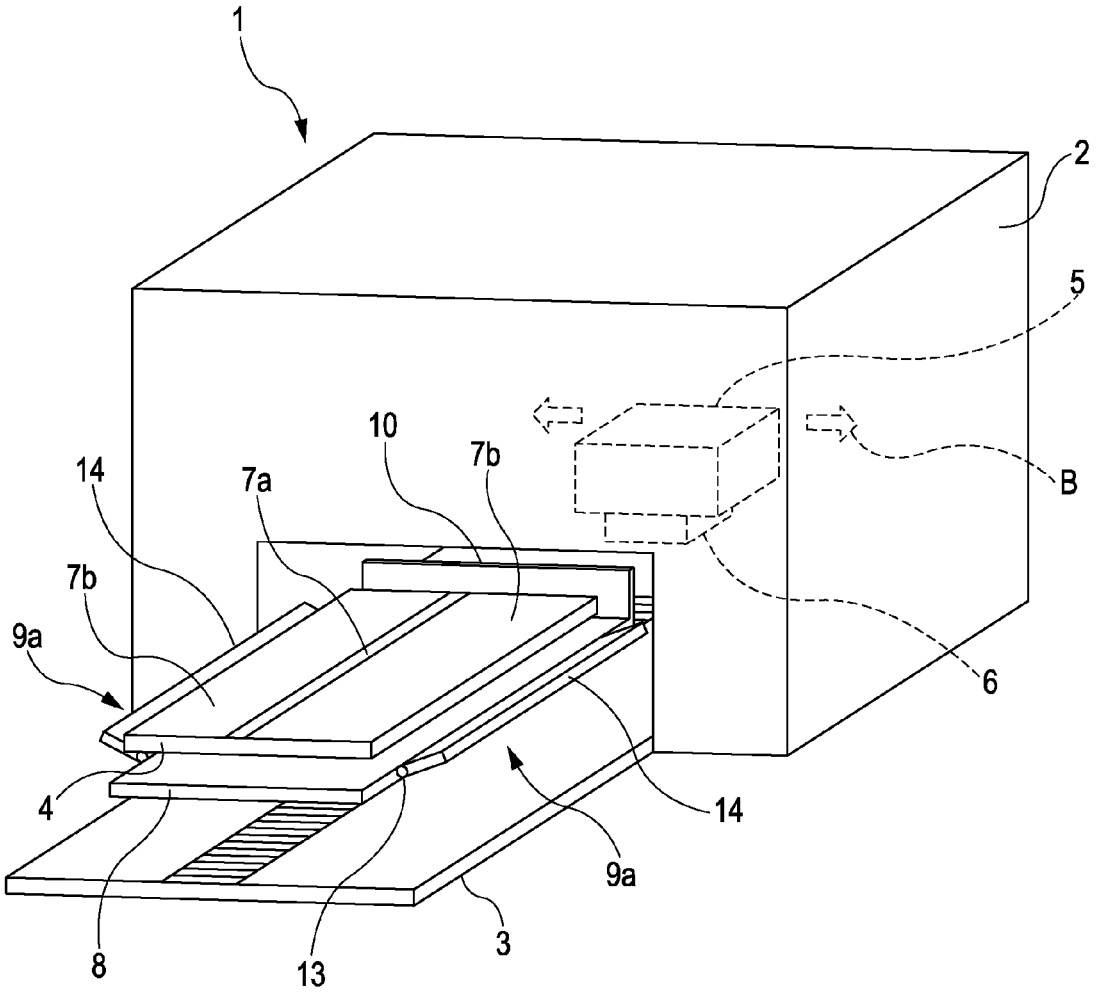
FIG. 8 is a schematic perspective view of the recording apparatus according to a sixth embodiment of the invention.

Sixth Embodiment (FIG. 8)

FIG. 8 is a schematic perspective view of the recording apparatus according to the sixth embodiment of the invention. The same reference numeral will be given to the same configuration member in the first embodiment and repeated description thereof will be omitted.

The recording apparatus 1 of the embodiment has a region 7*a* having a great coefficient of friction to the recording medium P and a region 7*b* having a coefficient of friction to the recording medium less than that of the region 7*a* in the set surface of the tray 4. When the recording medium P is set on the tray 4 and the force is applied to the protruding portion of the set surface of the recording medium P by the wing-shaped member 9*a*, the recording medium P may be pulled from the both left and right sides with respect to the transportation direction A on the basis of the region 7*a*. In other words, the recording medium P set on the set surface may be effectively pulled and the wrinkle may be effectively suppressed.

Furthermore, in the embodiment, the region 7*a* is at the center in a direction perpendicular to the transportation direction A and is provided in a band shape along the transportation direction A. However, the invention is not limited to such a configuration.

Figure 9:
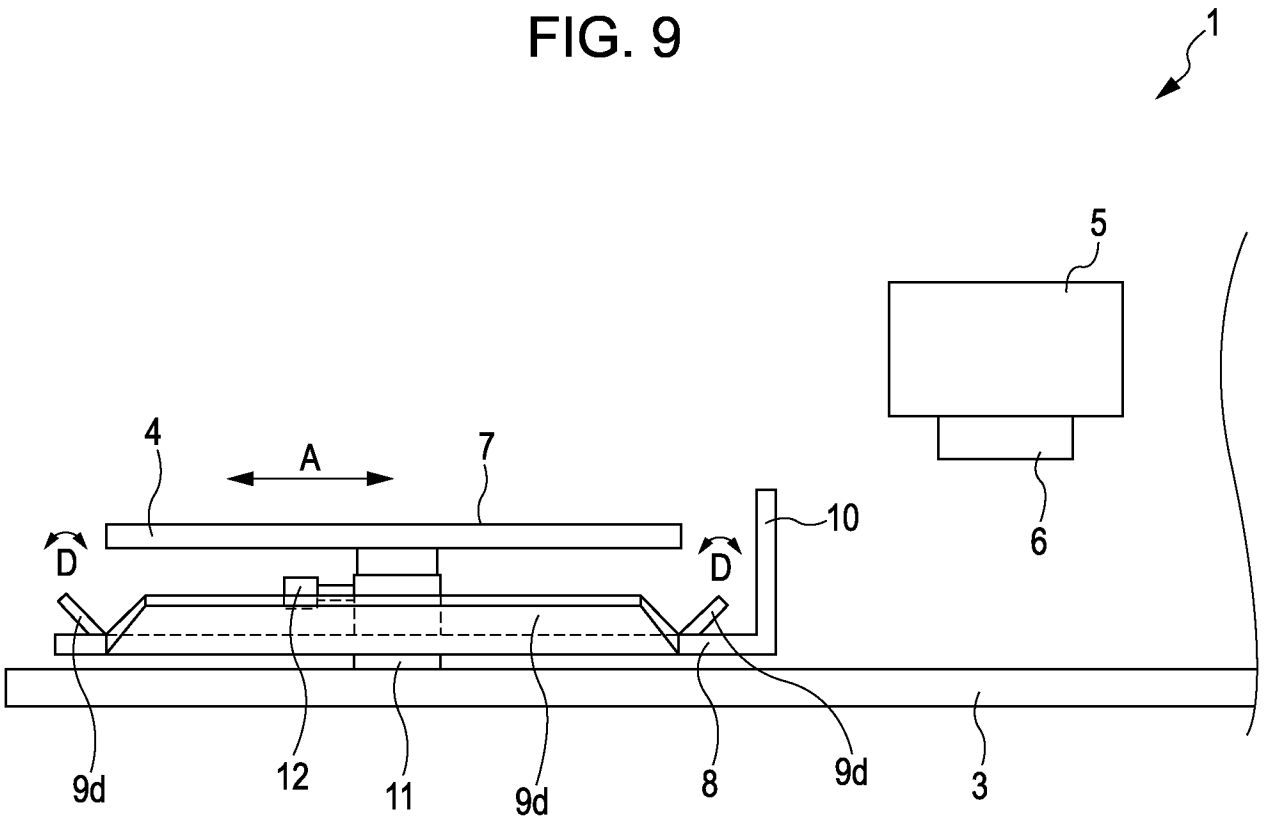
FIG. 9 is a schematic side view of the recording apparatus according to a seventh embodiment of the invention.

Seventh Embodiment (FIG. 9)

FIG. 9 is a schematic side view of the recording apparatus of the seventh embodiment of the invention. The same reference numeral will be given to the same configuration member in the first embodiment and repeated description thereof will be omitted.

The receiving tray 8 of the recording apparatus 1 of the embodiment has the wing-shaped members 9*d* of the fourth embodiment in both left and right sides with respect to the transportation direction A along the transportation direction A. Furthermore, the receiving tray 8 of the recording apparatus 1 of the embodiment also has the wing-shaped members 9*d* capable of rotating in a rotation direction D in both front and back sides with respect to the transportation direction A. Accordingly, the recording apparatus 1 of the embodiment has the wing-shaped members 9d in four directions and may pull the protruding portion of the set surface 7 of the recording medium P in four directions. In other words, the recording medium P set on the set surface 7 may be effectively pulled and the wrinkle may be effectively suppressed.

In addition, since the wing-shaped member 9*d* of the embodiment has a trapezoidal shape, there is no interference (contact), respectively, even though the wing-shaped member 9*d* abuts the protruding portion in four directions. However, the invention is not limited to such a configuration.

Figure 10:
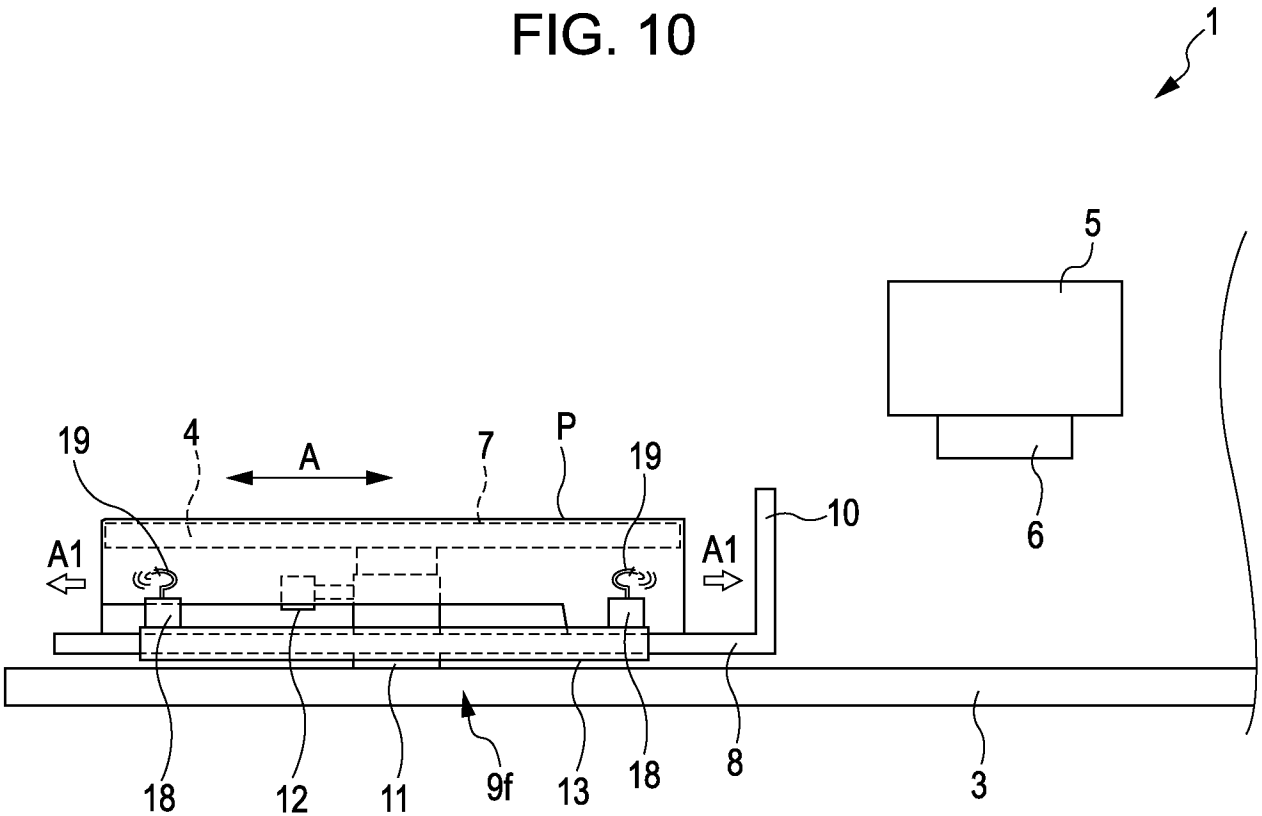
FIG. 10 is a schematic side view of the recording apparatus according to an eighth embodiment of the invention.

Eighth Embodiment (FIG. 10)

FIG. 10 is a schematic side view of the recording apparatus of the eighth embodiment of the embodiment. In addition, the same reference numeral will be given to the same configuration member in the first embodiment and repeated description thereof will be omitted.

The recording apparatus 1 of the embodiment has wing-shaped members 9*f* as the pulling mechanism in both left and right sides with respect to the transportation direction A of the receiving tray 8. The wing-shaped member 9*f* is configured with the connection section 13 capable of rotating in the transport direction A which is set as a direction of the rotation shaft, a rod-shaped member 18 provided in the connection section 13 and a hook 19 provided in the rod-shaped member 18. The rod-shaped members 18 are provided in both ends of the connection section 13 in the longitudinal direction thereof, respectively, and the hooks 19 are provided in the front ends of the rod-shaped members 18, respectively.

The hook 19 serves as the abutting section capable of coming into contact with the protruding portion of the set surface 7 of the recording medium P and as a pressing section which applies the force in the transportation direction A so that the tension acts on the recording medium P in a direction A1. Furthermore, the hook 19 also serves as the abutting section in the pulling mechanism which pulls the set portion of the recording medium P on the set surface 7 from the both left and right sides with respect to the transportation direction A.

In addition, the recording apparatus 1 of the embodiment has two hooks 19 as the abutting section and the pressing section with respect to one wing-shaped member 9*f*, however, the invention is not limited to such a configuration and the invention may have three or more hooks. Embodiment of Method of Manufacturing Recorded Matter (FIG. 11)

Next, the method of manufacturing the recorded matter of the invention will be described.

Figure 11:
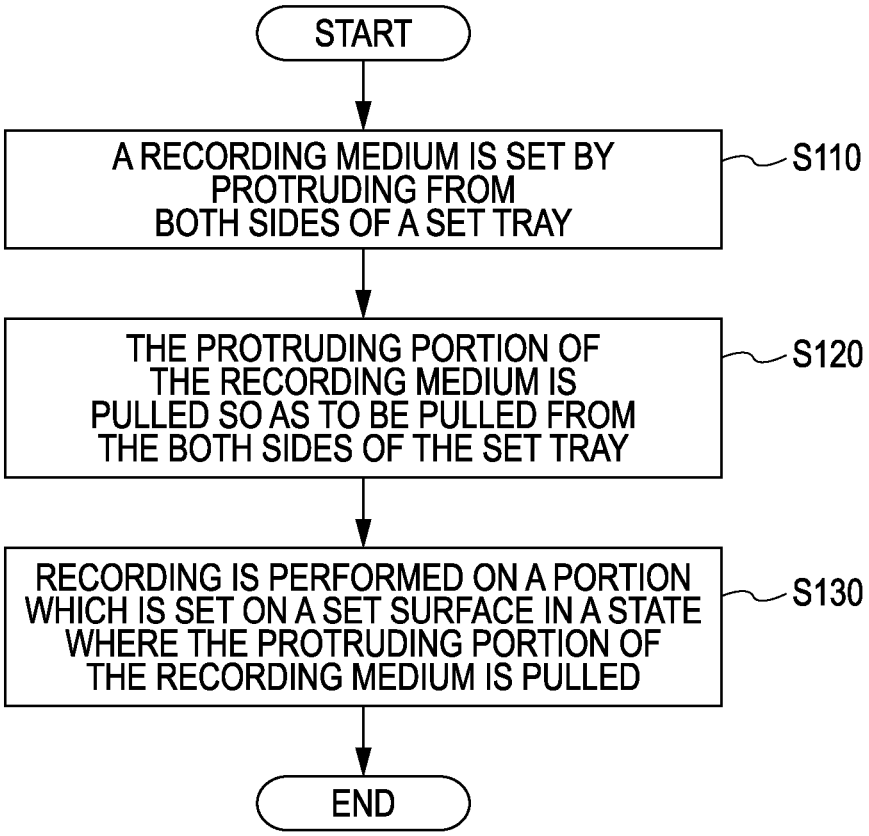
FIG. 11 is a flowchart of a method of manufacturing the recorded matter in accordance with an embodiment of the invention.

FIG. 11 is a flowchart illustrating an embodiment of the method of manufacturing the recorded matter of the invention. The embodiment is the method of manufacturing the recorded matter which is performed using the recording apparatus 1 of the first embodiment. However, the method of manufacturing the recorded matter of the invention is not limited to the method of manufacturing the recorded matter which is performed using the recording apparatus 1 of the first embodiment.

Initially, in step S110, the recording medium P is set on the tray 4 by protruding from the both left and right sides with respect to the transportation direction A.

Next, in step S120, the wing-shaped members 9*a* applies the force to the protruding portion of the set surface 7 of the recording medium P so as to pull the portion of the recording medium P which is set on the set surface 7 from the both sides thereof. In step S120, the wrinkle of the portion which is set on the set surface 7 is removed.

Next, in step S130, the recording is performed on the portion of the recording medium P which is set on the set surface 7 in a state where the wing-shaped members 9*a* apply the force to the protruding portion of the set surface 7 of the recording medium P. In other words, in the step S130, the recording is performed on the recording medium P in a state where the wrinkle is removed. Upon termination of the recording, the process of the method of manufacturing the recorded matter of the embodiment is finished.

What is claimed is:

1. A recording apparatus comprising:

a tray having a set surface on which a recording medium is set;

a recording section performing recording with respect to a region of the recording medium, which is set on the set surface so as to have a protruding portion protruding from a set surface of the recording medium; and a pulling mechanism which applies a force to the protruding portion in a first direction to pull a set surface portion of the recording medium, which is set on the set surface;

wherein the pulling mechanism has an abutting section capable of abutting the protruding portion and a connection section on opposite sides of the abutting section, the connection section being capable of rotating in the second direction orthogonal to the first direction which is set as a rotation shaft, and wherein the abutting section abuts the protruding portion by rotating around the rotation shaft.

2. The recording apparatus according to claim 1, wherein the connection section has a free stop function.

3. The recording apparatus according to claim 1, wherein the abutting section abuts the protruding portion by an own weight of the pulling mechanism when the pulling mechanism is inclined.

4. The recording apparatus according to claim 1, wherein the pulling mechanism has a biasing member pressing the abutting section to the protruding portion.

5. The recording apparatus according to claim 1, wherein the pulling mechanism includes a refraction section between the connection section and the abutting section along the second direction, and is capable of refracting along the second direction.

6. The recording apparatus according to claim 1, wherein the pulling mechanism has a plurality of the abutting sections.

7. The recording apparatus according to claim 1, further comprising:

a moving mechanism which relatively moves the tray with respect to the recording section in the second direction orthogonal to the first direction.

8. A recording apparatus comprising:

a tray having a set surface on which a recording medium is set;

a recording section performing recording with respect to a region of the recording medium, which is set on the set surface so as to have a protruding portion protruding from a set surface of the recording medium; and a pulling mechanism which applies a force to the protruding portion in a first direction to pull a set surface portion of the recording medium, which is set on the set surface;

wherein a first region in the set surface has a coefficient of friction to the recording medium, which is greater than that of region other than the first region in the set surface.

9. A recording apparatus comprising:

a tray having a set surface on which a recording medium is set;

a recording section performing recording with respect to a region of the recording medium, which is set on the set surface so as to have a protruding portion protruding from a set surface of the recording medium; and a pulling mechanism which applies a force to the protruding portion in a first direction to pull a set surface portion of the recording medium, which is set on the set surface;

wherein the pulling mechanism is capable of applying a force to the protruding portion protruding from the set surface of the recording medium such that the set surface portion of the recording medium, which is set on the set surface, is pulled from the both sides in the first direction and the second direction orthogonal to the first direction, respectively.

* * * * *